US009404321B2

(12) United States Patent
Williams

(10) Patent No.: US 9,404,321 B2
(45) Date of Patent: Aug. 2, 2016

(54) OILFIELD LIFT CAP AND COMBINATION TOOLS

(71) Applicant: DWJ INC., Lafayette, LA (US)

(72) Inventor: Donald L. Williams, Lafayette, LA (US)

(73) Assignee: DWJ Inc., Lafayette, LA (US)

( * ) Notice: Subject to any disclaimer, the term of this patent is extended or adjusted under 35 U.S.C. 154(b) by 0 days.

(21) Appl. No.: 14/667,543

(22) Filed: Mar. 24, 2015

(65) Prior Publication Data

US 2015/0308200 A1 Oct. 29, 2015

Related U.S. Application Data

(60) Provisional application No. 61/983,389, filed on Apr. 23, 2014.

(51) Int. Cl.
*E21B 19/02* (2006.01)
*B66C 1/66* (2006.01)

(52) U.S. Cl.
CPC .. *E21B 19/02* (2013.01); *B66C 1/66* (2013.01)

(58) Field of Classification Search
CPC ..... E21B 19/02; E21B 19/00; E21B 19/16; E21B 21/10; E21B 33/03; B66C 1/66
USPC ..... 166/85.1
See application file for complete search history.

(56) References Cited

U.S. PATENT DOCUMENTS 1,635,749 A 7/1927 Hosmer
1,754,692 A * 4/1930 Miller ..... E21B 19/00 294/215
2,139,983 A 12/1938 Stone
2,624,610 A * 1/1953 Murphy ..... E21B 19/06 294/96
2,647,728 A 8/1953 Smith
2,752,119 A 6/1956 Allen et al.
3,066,590 A 9/1957 Böhm
2,894,715 A 7/1959 Bostock
3,035,808 A 5/1962 Knox
RE25,471 E 11/1963 Fredd (Continued)

OTHER PUBLICATIONS

ABS; Mobile Offshore Drilling Units—Classification, Certification & Related Services; at least as early as Apr. 2014; ABS, Houston, TX; US.

(Continued)

*Primary Examiner* — Robert E Fuller
*Assistant Examiner* — Steven MacDonald
(74) *Attorney, Agent, or Firm* — Jeffrey L. Wendt; The Wendt Firm, P.C.

(57) ABSTRACT

A modular tool body having upper and lower sections, a pair of longitudinal members define a central open region, the longitudinal members joined at one end having a lifting feature formed therein configured to accept a manipulator. The lifting feature is positioned such that when the modular tool body and a rig tool connected thereto are lifted by the manipulator, they are easily moved over, aligned with, and connected with a working drillpipe or other rig tool while minimizing possibility of the manipulator slipping off. The lower section includes a threaded end mating with a mating end of a rig tool, a central longitudinal bore, and an upper end formed to accept the lower ends of the longitudinal members of the upper section. Elongate slots in each longitudinal member define one or more manipulating handles. A pair of generally horizontal hand holds may be formed in each longitudinal member.

21 Claims, 13 Drawing Sheets

(56) References Cited

U.S. PATENT DOCUMENTS

| | | | |
|---|---|---|---|
| 3,126,908 | A | 3/1964 | Dickens |
| 3,667,505 | A | 6/1972 | Radig |
| 3,667,557 | A | 6/1972 | Todd et al. |
| 3,783,942 | A | 1/1974 | Mott |
| 3,835,925 | A | 9/1974 | Mott |
| 3,850,191 | A | 11/1974 | Brown |
| 3,850,194 | A | 11/1974 | Brown |
| 3,861,470 | A | 1/1975 | Mott |
| 3,941,348 | A | 3/1976 | Mott |
| 4,040,441 | A | 8/1977 | Brown et al. |
| 4,049,015 | A | 9/1977 | Brown et al. |
| 4,074,761 | A | 2/1978 | Mott |
| 4,088,298 | A | 5/1978 | Brown et al. |
| 4,108,203 | A | 8/1978 | Brown |
| 4,125,164 | A | 11/1978 | Terry |
| 4,263,936 | A | 4/1981 | Brown |
| 4,291,762 | A | 9/1981 | Gudgel |
| 4,294,314 | A | 10/1981 | Miyagishima et al. |
| 4,403,628 | A | 9/1983 | Niijar |
| 4,417,600 | A | 11/1983 | Kohn |
| 4,467,823 | A | 8/1984 | Shaffer et al. |
| 4,478,279 | A | 10/1984 | Puntar et al. |
| 4,480,813 | A | 11/1984 | Holley |
| 4,523,608 | A | 6/1985 | Miller |
| 4,650,153 | A | 3/1987 | Winegeart |
| 4,681,133 | A | 7/1987 | Weston |
| 4,694,855 | A | 9/1987 | Cunningham |
| 4,795,128 | A | 1/1989 | Krasnov et al. |
| 5,246,203 | A | 9/1993 | McKnight et al. |
| 5,507,467 | A | 4/1996 | Mott |
| 5,529,285 | A | 6/1996 | McKnight et al. |
| 6,158,505 | A | 12/2000 | Araujo |
| 6,712,147 | B2 | 3/2004 | Dallas |
| 7,108,081 | B2 | 9/2006 | Boyadjieff |
| 7,137,453 | B2 | 11/2006 | Gustafson et al. |
| 7,308,954 | B2 | 12/2007 | Martin-Marshall |
| 7,950,668 | B2 | 5/2011 | Gustafson et al. |
| 8,230,931 | B2 | 7/2012 | Rodriguez et al. |
| 8,443,876 | B1 | 5/2013 | Keast |
| 8,443,877 | B1 | 5/2013 | Keast |
| 2013/0043044 | A1 | 2/2013 | Garber et al. |
| 2015/0068768 | A1 | 3/2015 | Williams |

OTHER PUBLICATIONS

Shilling et al., Development of Fatigue Resistant Heavy Wall Riser Connectors for Deepwater HPHT Dry Tree Riser Systems, Proceedings of the ASME 28th International Conference on Ocean, Offshore and Arctic Engineering; May 31-Jun. 5, 2009; ASME; New York, NY; US.

M & M Internatonal; Ball Valves Product Information Sheet; at least as early as Apr. 2014; M & M International; Broussard, LA; US.

McMaster-Carr; Quick-Release One-Piece Clamp-on Shaft Collar product information sheet; Sep. 10, 2013; McMaster-Carr, Atlanta, GA; US.

McMaster-Carr; Steel Round Knurled-Rim Knob product information sheet; Sep. 10, 2013; McMaster-Carr, Atlanta, GA; US.

Moffat 2000 Limited; Moffat Subsea Stab Connector™; no month, 2010; Moffat (2000) Ltd; Northumberland, UK.

TIW Corporation; Pressure Control Systems; Safety & Kelly Valve Systems; at least as early as Apr. 2014; TIW Corporation; A Pearce Industries Company; Houston, TX; US.

WNCO Valve International; Inside B.O.P. Dart Valves; no month, 2013; WNCO Valve International, Odessa, TX; US.

* cited by examiner

OILFIELD LIFT CAP AND COMBINATION TOOLS

BACKGROUND INFORMATION

1. Technical Field

The present disclosure relates to apparatus and methods in the onshore and marine (offshore) hydrocarbon exploration, production, drilling, well completion, well intervention, and leak containment fields. More particularly, the present disclosure relates to tools useful for pick up, make up, and/or break down operations for oilfield equipment having threaded connections, including, but not limited to, inside blowout preventers, TIW valves, drill stem safety valves, kelly valves, dart valves, flapper valves, ball valves, safety valves, top drive valves (upper and lower), and the like.

2. Background Art

There are many drill string/drill stem components that may require "picking up" (lifting) by drill rig workers and/or a drill rig draw works, air tugger, or air hoist. Presently, this is accomplished by attaching a conventional "lift cap" to the top of the component, and lifting the combination lift cap and component. The component, with attached conventional lift cap, must then be "stabbed" into the upper end of the drill string and "made up" with (secured to) the drill string by threaded connections. Workers grab the lift cap itself, or use the chain tongs to grab the lift cap and turn the lift cap and component so that threads on the component engage threads on the drill string. For example, a "blowout (or blow out) preventer", commonly known as a "BOP", is a valve that may be used to prevent a well, usually a hydrocarbon producing well, from flowing uncontrollably. An "inside BOP" (also sometimes referred to as an "internal BOP", "IBOP", "kelly valve", TIW valve, or "kelly cock") is a BOP inside a drillpipe or drillstring, usually used to prevent the well from flowing uncontrollably up the drillstring during drilling. Industry standards require having an IBOP for every string of pipe in the hole on every rig that is working. Drilling contractors are now also being instructed they must stab a "Full Opening" (TIW) valve first, before the IBOP, if the well is flowing. (TWI stands for Texas Irons Works, an older style valve having a two-piece valve body. These are now more generally referred to in the art as a kelly valve.) Analogous valves are used during well completion and workover, and usually referred to as safety valves. The present disclosure is applicable to all such valves and components that must be lifted, made up, and broken out, and referred to herein as "rig tools", since they frequently appear on drilling rigs and are used by rig workers.

In present practice, the TIW or kelly valve is typically positioned on the rig adjacent the IBOP, with the IBOP next to the drill pipe, and there is a conventional lift cap screwed into the top of the TIW valve. However, with conventional lift caps there is presently no way for rig workers to make up a TIW or kelly valve, an IBOP valve, or any other component with the drill string unless the workers use the drill rig air hoist to lift the component by the conventional cap and walk in a circle while making it up with the drill string, either with or with out use of chain tongs.

Currently, IBOP valves, TIW valves, kelly valves, safety valves, and other such valves and components, which may weigh 300 pounds or more, have no lifting eyes on their conventional cap or otherwise, although separate lifting devices that attach to the drillpipe and/or the component may have one or more lifting eyes, as taught in U.S. Pat. No. 4,291,762. At least for IBOP valves, they have been this way for many years. FIGS. 1A, 1B, and 1C are perspective views of three non-limiting representative examples of such IBOP valves each fitted with a conventional cap. There are many types of IBOP valves, drill stem safety valves, kelly valves, and the like, and the present disclosure is relevant to all. U.S. Pat. Nos. 2,647,728; 3,066,590; 3,667,557; 3,835,925; 3,861,470; 3,941,348; 4,291,762; 4,294,314; 4,403,628; 4,417,600; 4,467,823; 4,478,279; 4,480,813; 4,523,608; 4,681,133; 4,694,855; 4,795,128; 5,507,467; 5,246,203; 5,529,285; 7,137,453; 7,950,668, and 7,108,081; 8,443,876; 8,443,877; and U.S. Published patent application no. 2013/0043044A1 all describe various types of IBOPs, kelly valves, TIW valves and/or accessories for same, such as actuators for IBOPs. Other examples of IBOPs may presently be found on the Internet websites of companies such as WNCO, Global Manufacturing and M&M Industries. All of these patents, published patent applications, and Internet websites are incorporated herein by reference for their disclosure of structure and operation of IBOPs, kelly valves, TIW valves and/or accessories for same, such as actuators for IBOPs, drill stem safety valves, kelly valves.

In current practice in the field, the drilling rig workers make up a conventional cap 14 to the upper threaded end of a valve body 2, wrap a chain or strap around the conventional lift cap 14, pick up the combination with the air hoist, and stab the lower threaded end (not shown) of the valve body into the drillpipe. In situations where a TIW or kelly valve is installed first, they then break down the conventional cap from the TIW valve body and make up the conventional cap to the upper threaded end of an IBOP valve body, again tie a chain or strap around the conventional lift cap, pick up the combination with the air hoist, and make up the bottom threaded end of the IBOP with top threaded end of the TIW valve body. In the case of a TIW valve, kelly valve, or IBOP, the valve itself must be open in order to screw the valve body into the drill pipe. If the TIW/kelly is closed, the IBOP may or may not be closed when installing it onto the TIW valve body. If the TIW/kelly valve is not open the pressure will blow it out before the threads can be started. The drilling rig workers turn the valve body clockwise by hand to screw the TIW valve body into the drillpipe, and the IBOP valve body into the TIW valve body. In some instances, rig workers grab round rods 21 welded to the conventional cap 14 while picking it up and turn the valve body using the round rods. Then they tighten the threads with the rig chain tongs, close the TIW or kelly valve using a tool specific for the TIW or kelly valve, and the well is secure. The IBOP valve may then be made up to the TIW valve body as explained. Mud or other drilling fluid may then be pumped through the valves down hole but no pressurized fluids may come out of the drillpipe.

One of the above patents, U.S. Pat. No. 4,403,628, implies in Col. 3 of the patent that assembling an IBOP into a drill stem and removing the IBOP therefrom as just described, including lifting and manipulating the IBOP, is conveniently performed; however, this is contrary to experience, as accidents can and have occurred. Rig personnel safety is of utmost concern. The inventor herein personally knows of several accidents where the chain of the air hoist slipped off the old style cap, dropping an IBOP. No doubt this has occurred with TIW/kelly valve caps as well. While the "iron" (slang term for rig tools) is accustomed to being dropped and otherwise abused on the rig, the rig workers have the difficult tasks of not only picking up the rig tools, using chains or straps with the air hoist or otherwise, but picking them up straight (vertical or substantially vertical) to align with and screw onto the working drillpipe, which more often than not has fluids and possibly solids escaping out at a high rate. Experience shows that when rig workers are required to make a loop with a chain, cable, or strap around the whole valve (for example around two conventional cap handles) it rarely if ever picks up straight (so that the valve is vertical); it is then necessary to attempt to get it straight to get the threads started in the drillpipe threads. In the meantime, the valve or other rig components shift position and the conventional cap/valve combination slips off the chain, cable, or strap, with potential to injure rig workers, and without stopping flow from the drillpipe. Complications only increase on offshore rigs, whether working subsea or "dry" at the surface on the rig.

As may be seen, current practice of picking up, making up, and breaking out TIW valves, IBOPs, and other drill string components which must be picked up and made up to the drill string may not be adequate for all circumstances, and at worst have resulted in injury to rig workers. There remains a need for more robust lift cap designs allowing pick up, make up, and break out of rig tools such as IBOPs and TIW valves, particularly for apparatus and methods allowing safe and quick connection/disconnection and ease of alignment, without extra tools, lifting frames, or effort. The apparatus and methods of the present disclosure are directed to these needs.

SUMMARY

In accordance with the present disclosure, modular tools for lifting, stabbing, making up, and or breaking down IBOPs, TIW valves, and other rig tools are presented, and methods of assembling combinations of the modular tool and various rig tools, and making up the drill string, and methods of using same are described which reduce or overcome many of the faults of previously known lift caps and methods. The modular tools (sometimes referred to as modular lift caps) of the present disclosure include specially designed (machined, cast, or molded, but not welded or brazed) chain lifting features and handles allowing rig workers to lift, stab, and make up rig tools to drillpipe all in one motion. In the case of picking up a TIW or kelly valve, rig workers may have a combination modular tool/kelly valve already made up, and when needed pick up the combination modular tool/kelly valve by a lifting feature ensuring it is substantially vertical, stab the combination into the drill pipe while the well is flowing out the big opening at the top, and use the modular tool handles instead of hunting for a pair of chain tongs to make up hand tight, remove the modular tool afterward and screw another component or the rig top drive directly into the TIW or kelly valve, or IBOP.

A first aspect of the disclosure is a modular tool body comprising:

a one-piece, formed (defined herein as including milled, machined, molded, cast, machined or milled billet, but not welded or brazed), planar metallic upper section having a longitudinal axis, the upper section comprising a pair of longitudinal members defining a central open region, each longitudinal member having a lower end, the longitudinal members joined by a top manipulating end having one or more lifting features formed therein configured to accept one or more manipulators (cables, chains, straps, or ropes connected to a rig hoist), the one or more formed lifting features positioned such that when the modular tool body and a rig tool (such as an IBOP, TIW valve, drill stem test valve, kelly valve, and the like) connected thereto are lifted by the one or more manipulators, they are easily moved over, aligned with, and connected with a working drillpipe or other valve while minimizing possibility of slipping off the cables, chains, or straps; and a one-piece, formed, tubular metallic lower section removably attached to the upper section having the same longitudinal axis as the upper section, the lower section comprising:

a threaded (preferably externally tapered pin) end configured to threadedly mate with an end (preferably a box end) of at least one, preferably more than one rig tool;

a central longitudinal bore; and an upper end formed to accept the lower ends of the longitudinal members of the upper section and retaining members therefore.

In certain embodiments, the one or more lifting features may be a single centered lifting eye formed through the top manipulating end of the upper section. Certain embodiments may comprise one or more formed, elongate slots in each longitudinal member of size sufficient to define one or more manipulating handles for a rig worker or mechanical manipulator to grasp the upper section and rotate the modular tool body and thread the pin end of the lower section into the box end of the rig tool. In certain embodiments the upper end of the lower section may be formed to include a pair of vertical receptacles for the lower ends of the upper section, wherein the retaining members may comprise one or more screws, bolts, pins, and the like threaded (or otherwise positioned and secured) through corresponding threaded (or other) bores through the receptacles and lower ends.

Another aspect of the disclosure is a modular tool for use with one or more rig tools (such as IBOP and TIW valves) comprising the modular tool body; and one or more formed, elongate slots in each longitudinal member of size sufficient to define one or more manipulating handles for a rig worker or mechanical manipulator to grasp the upper section and rotate the modular tool body and thread the pin end of the lower section into the box end of one or more rig tools.

Another aspect of the disclosure is a combination modular tool and rig tool for threadedly attaching the rig tool to a drillpipe or to another component (such as a same or different rig tool), the drillpipe or other rig tool having a threaded end (preferably an enlarged external diameter internally threaded upset end) for engaging the rig tool, the combination comprising a rig tool having a lower end threadably engageable with the drillpipe threaded end and an upper box end threadably engaged with a modular tool body of the present disclosure.

In addition to the features already mentioned, modular tools and combinations of modular tool/rig tool may further comprise a combination of metallurgy and structural reinforcement such as to prevent failure of the rig tool (for example an IBOP, TIW, drill stem test valve, and the like) and/or modular tool upon exposure to inner pressure up to 10,000 psia, or up to 15,000 psia, or up to 20,000 psia, or up to 25,000 psia, or up to 30,000 psia or higher, such as may be experience during onshore or offshore subsea drilling, completion, workover, production, and other oilfield operations. Especially for offshore subsea applications, certain embodiments may further comprise one or more of the following features: one or more subsea hot stab ports for subsea ROV (remotely operated vehicle) intervention and/or maintenance of the rig tool; one or more ports allowing pressure and/or temperature monitoring inside the rig tool; one or more subsea umbilicals fluidly connected to one or more locations on the rig tool selected from the group consisting of a kill line, a choke line, and both kill and choke lines, optionally wherein one of the umbilicals is fluidly connected to a subsea manifold. Certain embodiments may include a one-piece, formed, tubular metallic fluid diversion cap removably attached to the upper section and having the same longitudinal axis as the upper and lower sections, the fluid diversion cap comprising an upper tubular end having slots dimensioned to substantially mate with a lower region of the top manipulating end of the upper section, a lower tubular end dimensioned to substantially mate with curved inner surfaces of the upper end of the lower section, and a fluid diversion opening substantially as described herein.

Another aspect of the disclosure is a method of easily and safely attaching a combination modular tool/rig tool having a lower threaded end to a threaded end of a working drillpipe or to another component, the method comprising the steps of:

(a) making up (assembling) combination;

(b) picking up (lifting) the combination substantially vertically using a rig hoist, the chain or other manipulator of the hoist passing through one or more lifting features formed into the upper section of the modular tool;

(c) stabbing the combination into a threaded end of a working drillpipe or to another component;

(d) making up the combination with the working drillpipe or other component using one or more manipulating handles formed in the upper section of the modular tool so that the threads of the lower end of the rig tool thread into the threads of the drillpipe or other component;

(e) optionally breaking down the combination modular tool/rig tool, making up the modular tool to a second rig tool to form a second combination, and repeating steps (b), (c), and (d) until the desired number of rig tools are stabbed and made up in the drill string; and (f) optionally breaking down and removing the modular tool, and screwing the rig top drive directly into the uppermost rig tool in the drill string.

An important feature of the apparatus and methods disclosed herein is the modularity, that is, the lower and upper sections of the modular tool body (and fluid diversion cap if present) may quickly and easily be disassembled, and the same upper section joined and used with another lower section of same or different outside diameter, such as if one section cracks or otherwise becomes unusable. In certain embodiments the lower section may be changed to accommodate a different diameter working drillpipe or rig tool, although that may rarely occur. In certain embodiments, the method comprises changing the lower section of the modular tool body to match size (outside diameter) of another rig tool prior to attaching the modular tool to another, different sized rig tool.

These and other features of the apparatus and methods of the disclosure will become more apparent upon review of the brief description of the drawings, the detailed description, and the claims that follow. It should be understood that wherever the term "comprising" is used herein, other embodiments where the term "comprising" is substituted with "consisting essentially of" are explicitly disclosed herein. It should be further understood that wherever the term "comprising" is used herein, other embodiments where the term "comprising" is substituted with "consisting of" are explicitly disclosed herein. Moreover, the use of negative limitations is specifically contemplated; for example, certain modular tool body systems, modular tools, combination modular tool and rig tool for threadedly attaching the rig tool to a drillpipe or to another component, and methods may comprise a number of physical components and features, but may be devoid of certain optional hardware and/or other features.

BRIEF DESCRIPTION OF THE DRAWINGS

The manner in which the objectives of this disclosure and other desirable characteristics can be obtained is explained in the following description and attached drawings in which:

It is to be noted, however, that the appended drawings of FIGS. 1-4 and 6-13 may not be to scale, and illustrate only typical apparatus embodiments of this disclosure. Furthermore, FIG. 5 illustrates only one of many possible methods of this disclosure. Therefore, the drawing figures are not to be considered limiting in scope, for the disclosure may admit to other equally effective embodiments. Identical reference numerals are used throughout the several views for like or similar elements.

DETAILED DESCRIPTION

Figure 1C:
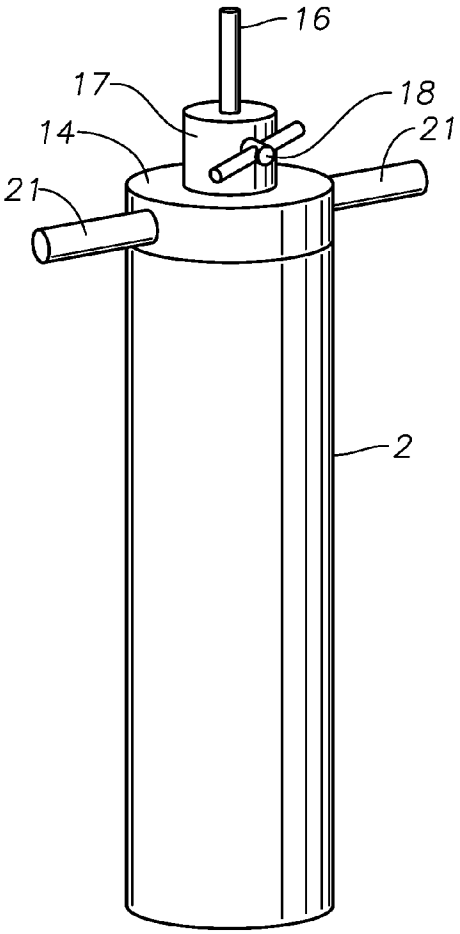
FIG. 1C (Prior Art)
FIGS. 1A, 1B, and 1C are schematic perspective views of three prior art, conventional lift caps in combination with three inside blowout preventers.

In the following description, numerous details are set forth to provide an understanding of the disclosed apparatus, combinations, and methods. However, it will be understood by those skilled in the art that the apparatus, combinations, and methods disclosed herein may be practiced without these details and that numerous variations or modifications from the described embodiments may be possible. All U.S. published patent applications and U.S. patents referenced herein are hereby explicitly incorporated herein by reference, irrespective of the page, paragraph, or section in which they are referenced.

The primary features of the apparatus, combinations, and methods of the present disclosure will now be described with reference to the drawing figures, after which some of the construction and operational details, some of which are optional, will be further explained. The same reference numerals are used throughout to denote the same items in the figures.

One aspect the present disclosure is a modular tool replacement for lift cap 14 (FIGS. 1A, 1B, and 1C) that is already on at least 1000 drilling rigs in operation today. The primary focus was to replace the old lift cap 14 with a new modular and safer design (one embodiment 100 of which is illustrated in schematic perspective view in FIG. 2) so rig workers or rig tools operated by rig workers could place chain or other lifting attachment through one or more lifting eye, and also provide hand slots to "make it up" (slang term for attaching two oilfield components, here the new lifting cap to a kelly valve, TIW valve, safety valve, IBOP valve, and the like). The modular tools of the present disclosure allow lifting, stabbing, and making up using specially designed lifting features and handles all in one motion. Once one component, for example a TIW valve body, is made up with the drill string and the valve closed, workers may then stab an IBOP safety valve. The drill string then has two safety barriers in the drill string. The IBOP would be removed from the drill pipe if it were to go below the rotary table. If the drill pipe stuck the drilling rig crew could not get a wire line through the IBOP to run a free point test and/or back-off. The modular tool of the present disclosure may be used to lift, stab, and make up TIW valves (typically a ball valve), inside blowout preventer valves (typically a dart valve), drill stem safety valves, kelly valves, dart valves, flapper valves, ball valves, safety valves, top drive valves (upper and lower), and the like.

Prior to explaining features of the modular tool and other inventive aspects, reference should again be made to FIGS. 1A-C, which are schematic perspective views of three prior art combinations of inside blowout preventers and conventional lifting caps 14. The inside blowout preventer ("IBOP") may includes an upper sub 2 and a lower sub 4 joined using tapered threads (not illustrated). One-piece IBOP valve bodies or housings, TIW valve bodies, and other housings are also known, and the tools of the present disclosure are applicable to either variety of body or housing. As is known in the art, an IBOP typically includes a spring biased to push up a dart into mating relationship with a dart "O" ring and dart seat. Other types of IBOP may feature a check valve (flap valve), and the modular tools of the present disclosure are suitable for use with any type of IBOP. Lower sub 4 includes a lower threaded end, not illustrated (either pin or box, usually a pin end) to threadably mate with a working drillpipe (either box or pin end, usually a box end). The drillpipe is not illustrated.

Figure 1B:
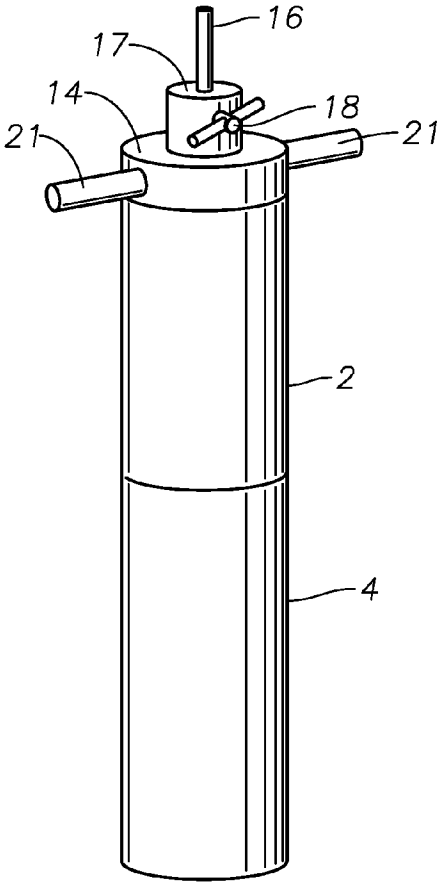
FIG. 1B (Prior Art)
Figure 1A:
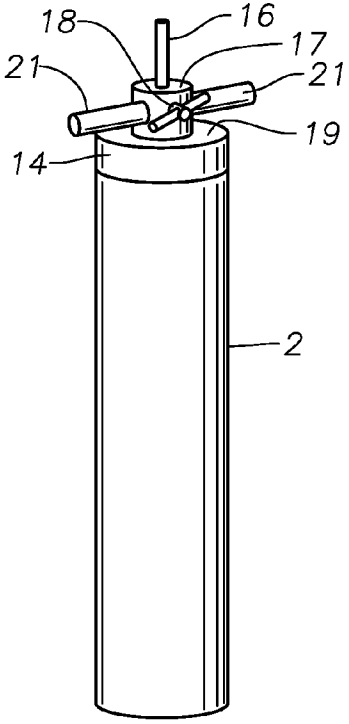
FIG. 1A (Prior Art)

Still referring to FIG. 1, prior art lift cap 14 includes a lower body (not illustrated) that threadedly mates with upper sub 2. Usually, the lower body includes external tapered threads and upper sub 2 includes mating internal tapered threads, but other arrangements are possible. Some prior conventional lift caps 14 further include a release rod 16 that extends through a bore of an axial extension 17, and a rod lock screw 18, the operation of which are very familiar to those of ordinary skill and require no further explanation. Some suppliers may provide one or more lateral "grab handles" 21 welded to the axial extension 17 (FIG. 1A) or to cap 14 itself (FIGS. 1B and 1C) if asked for by rig workers or rig owners (or rig workers/owners may weld them on after purchasing them). As may be seen, grab handles 21 are not very safe or even adequate for lifting in many situations, especially in wet, humid conditions.

Using prior art lifting caps such as 14, rig workers attempt to lift and move the combination IBOP/lift cap or kelly valve/lift cap into position over a working drillpipe for attachment. The problem is that the lateral grab handles 21 are not lifting eyes. They are hard to tie onto. Rig workers grab the grab handles 21 and pick up the device, align threads 20 with threads of the working drillpipe, and turn (rotate) the combination using grab handles 21. The IBOP or kelly or safety valve may weigh from 200 to 300 pounds (91 to 136 kg). Injury to rig workers is of utmost concern. While the "iron" (oilfield term for rig tools) is accustomed to being dropped and banged around the rig, the rig workers have the difficult tasks of not only picking up the cap and tool, using chains or otherwise, but picking it up straight (vertical or substantially vertical) to align with and screw onto the working drillpipe, which more often than not has fluids and possibly solids escaping out at a high rate. Experience shows that when rig workers are required to make a loop with a chain or cable around the whole valve (for example around two handles 21) it rarely if ever picks up straight; it is then necessary to attempt to get it straight to get the lower end threads started in the drillpipe threads. In the meantime, the valve or other rig components shift position and the valve slips off the chain, with potential to injury rig workers, and without stopping flow from the drillpipe.

Figure 2:
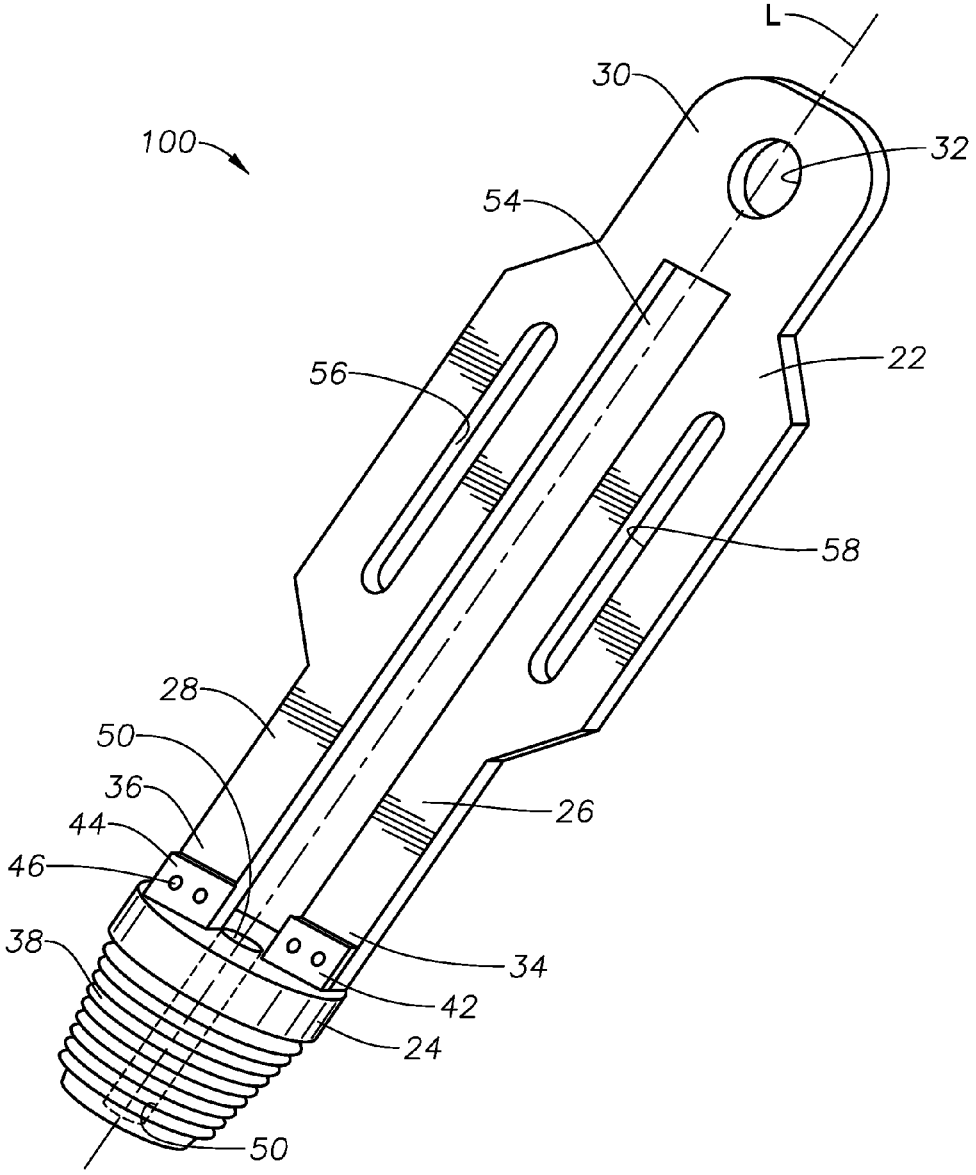
FIG. 2 is a schematic perspective view of one modular tool body embodiment within the present disclosure.

With these problems in mind, the modular tools of the present disclosure were developed. FIG. 2 is a schematic perspective view of one modular tool body embodiment 100 within the present disclosure. Modular tool body 100 includes an upper "flat iron" section 22 having a longitudinal axis "L", and a lower tubular section 24 of same longitudinal axis. Upper section 22 is comprised of two longitudinal members 26, 28, joined by a top manipulating end 30. Upper section 22 is a one-piece, formed, planar, metallic component with no welds or components welded thereto. This eliminates the need for pull testing (tensile testing) in offshore applications. Longitudinal members 26, 28 define a central open region 54 there between, each longitudinal member having a lower end 34, 36, respectively. Top manipulating end 30 includes one or more lifting features 32 formed therein configured to accept one or more manipulator cables, chains, or straps (not illustrated), the one or more milled lifting features 32 (lifting eye in FIG. 2) positioned such that when the modular tool body 100 and a rig tool connected thereto (such as depicted schematically in FIGS. 4, 6, and 7) are lifted by the cables, chains, or straps they are easily moved over, aligned with, and connected with a working drillpipe or rig tool attached thereto while minimizing possibility of the cables, chains, or straps slipping off. Severe injury to rig workers is thereby avoided, or at least the possibility greatly reduced, compared with previous designs.

Figure 4:
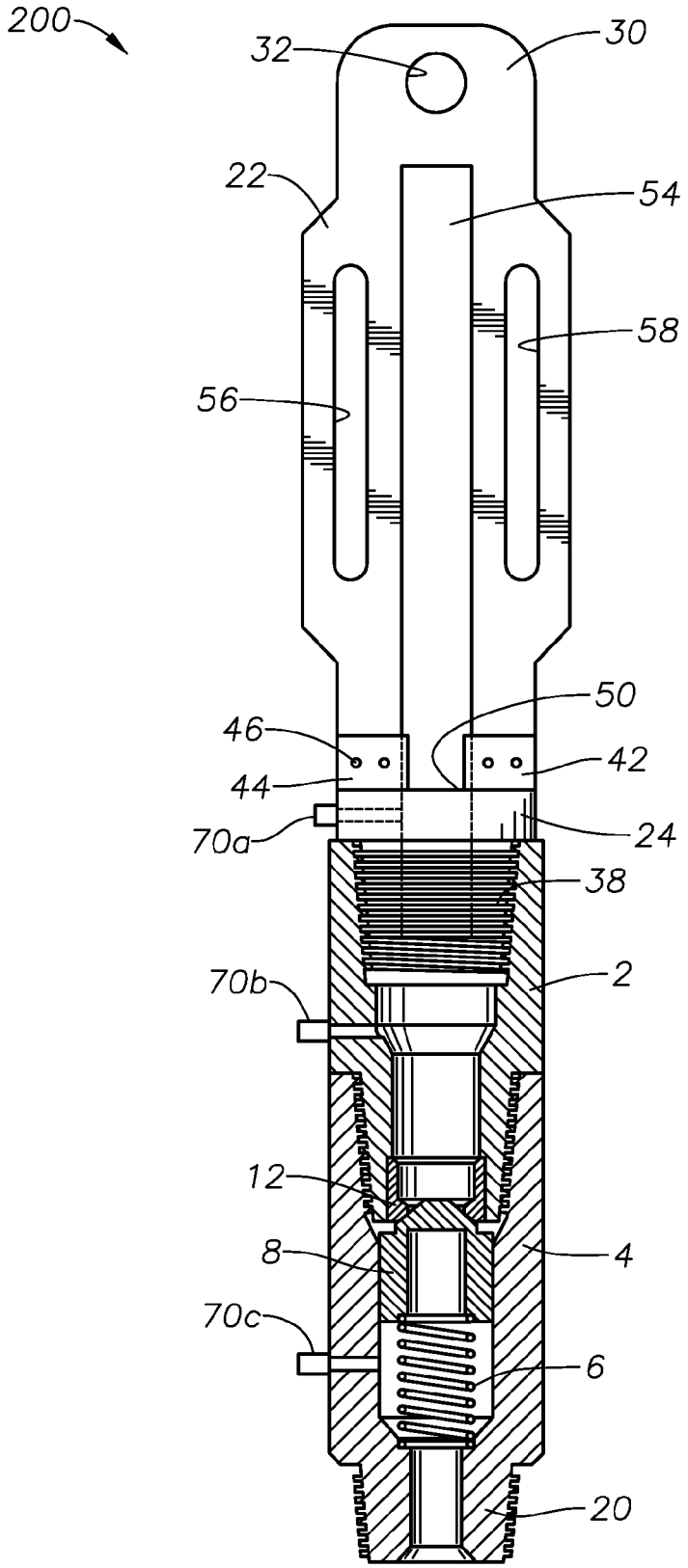
FIG. 4 is a schematic side elevation view, partly in cross-section, of a combination inside blowout preventer and modular tool within the present disclosure.

Still referring to FIG. 2, upper section 22 includes, in embodiment 100, a pair of elongate formed slots 56, 58, one each in this embodiment formed into and through longitudinal members 28, 26, respectively. Elongate formed slots 56, 58 serve as handles for turning modular tool 100 and rig tools attached thereto, (as illustrated in FIG. 4) when positioned and aligned with a working drillpipe. It will be appreciated the more than one slot (or other shaped) through-holes, may be provided in each longitudinal member 26, 28. It is not necessary that slots 56, 58, be the same length or shape; however, in order to provide the best weight balance, and therefore best ease of positioning and making up to the drillpipe, it is preferred that longitudinal member 26 be a substantial mirror image of longitudinal member 28, with slots of substantially equal length and shape.

Again referring to FIG. 2, lower section 24 includes a threaded end 38, preferably a tapered threaded end, illustrated in FIG. 2 as a pin end, having a central bore 50 illustrated partially in phantom. Central bore 50 directs flow of fluids and other matter out of modular tool 100 while it and the rig tool to which it is attached are being secured to the working drillpipe. Lower section 24 further includes a pair of formed receptacles 42, 44, perhaps more clearly illustrated in FIGS. 3A and 3B and discussed further herein below. Formed receptacles 42, 44 serve to accept and retain lower ends 34, 36 of longitudinal members 26, 28, in conjunction with retaining screws, bolts, pins or other components 46 (two retaining screws, bolts or pins 46 are illustrated for each receptacle 42, 44).

Figure 3B:
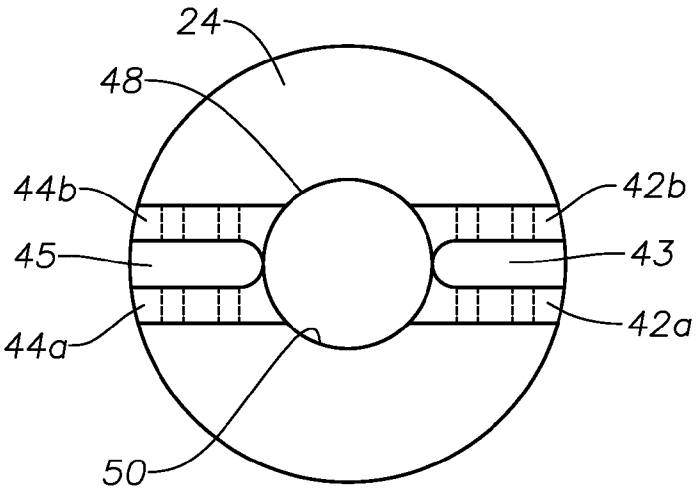
FIGS. 3A and 3B illustrate schematic side elevation and plan views, respectively, of the lower section of the release tool body embodiment illustrated in FIG. 2.
Figure 3A:
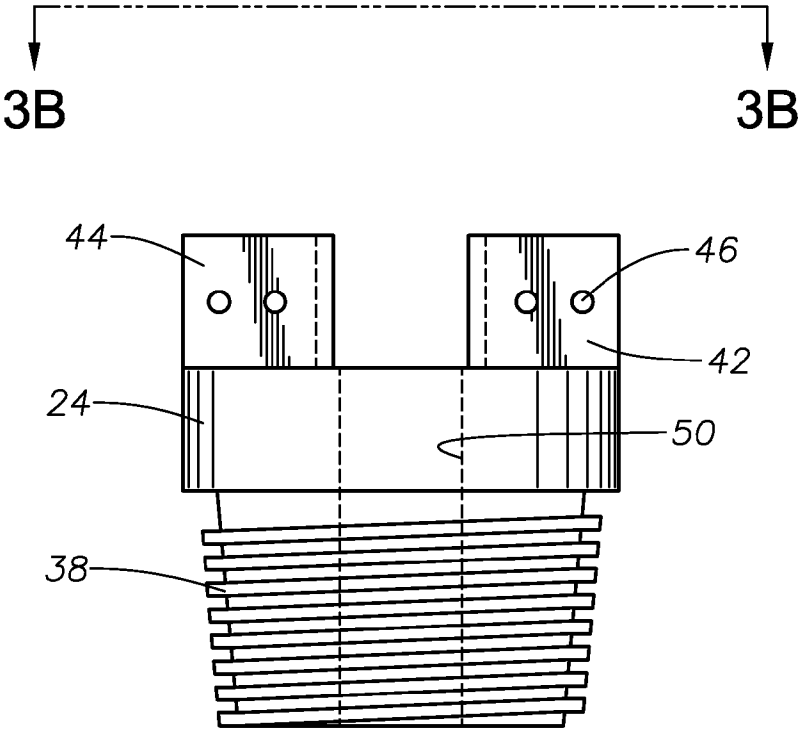

Referring now specifically to FIGS. 3A and 3B, FIG. 3A illustrates a schematic side elevation view, and FIG. 3B a plan view, respectively, of lower section 24 of the modular tool body embodiment 100 illustrated in FIG. 2. As illustrated in the plan view of FIG. 3B, receptacles 42 and 44 may each be formed into lower section 24 to form a pair of slots 43, 45 (slot 43 formed between sub-receptacles 42*a*, 42*b*, and slot 45 formed between sub-receptacles 44*a*, 44*b*, as illustrated). Slots 43, 45 accept ends 34, 36 of longitudinal members 26, 28, as previously explained. It should be noted that in alternative embodiments considered within the present disclosure, ends 34, 36 could be formed to form a female connection to fit onto male members 42, 44, respectively. Since torque is effected on upper section 22 when making up to a working drillpipe, the embodiment illustrated in FIGS. 2 and 3 may be preferred as being somewhat stronger. Slots 43, 45 are formed out of the bottom section so that no welding, brazing, or other heat-formed attachment is involved.

In practice, upper section 22 with lifting eye 32 is interchangeable with all lower sections 24 so that a relatively small batch of upper sections 22 could be made and distributed, whereby a user (rig owner and rig workers) could fit a single upper section 22 on multiple lower sections 24 to fit corresponding sizes of rig tools, in turn corresponding to a variety of sizes of working drill pipe as a well is drill or otherwise worked. While not strictly necessary, the hand holds formed in longitudinal members 26, 28 and slots 56, 58 are preferably flat (planar). For subsea use they maybe painted or otherwise colored or made reflective for ease of recognition. Structurally, the modular tool bodies of the present disclosure may support a weight of 3000 pounds (1360 kg) or more when made of 4140HT steel, or equivalent material.

FIG. 4 is a schematic side elevation view, partly in cross-section, of a combination inside blowout preventer and modular tool 200 within the present disclosure. The need for quickly aligning and threadably attaching an 1130P or other valve or rig tool to a working drillpipe in the event of a blowout or impending blowout is recognized in the art. What has not been recognized or realized is an apparatus and method to accomplish this without significant risk of the apparatus slipping off lifting devices and injuring rig workers or damaging the tools. As explained previously, external frames have been designed, some with lifting eyes, for effecting alignment, but these add cost and complexity to the procedure, or if available are not necessarily used or favored by rig personnel. Or the prior art simply states that alignment and connection is conveniently done without such external frames, using welded-on handles. The present inventor, however, personally knows such is not always the case, and knows of multiple accidents that have injured rig workers.

Upper section 24 is illustrated as threaded into upper sub 2 of a prior art IBOP, such as previously discussed in relation to FIG. 1, or some other rig tool. One or more subs 70*a*, 70*b*, and/or 70*c* may optionally be supplied, especially for subsea use. For example, one or more subs 70 may connect to a hydrate inhibition chemical supply line, and when circulating the chemical, it may return to a surface vessel through a return line via a second sub. One or more subs 70 may connect a surface chemical supply to subsea choke and kill valves via choke and/or kill lines. One or more of subs 70 may be hot stab connections, such as API 17H standard hot stabs, or a pressure gauge, or facilities to allow other kill line parameters to be measured, for example, temperature, viscosity, and the like.

Figure 5:
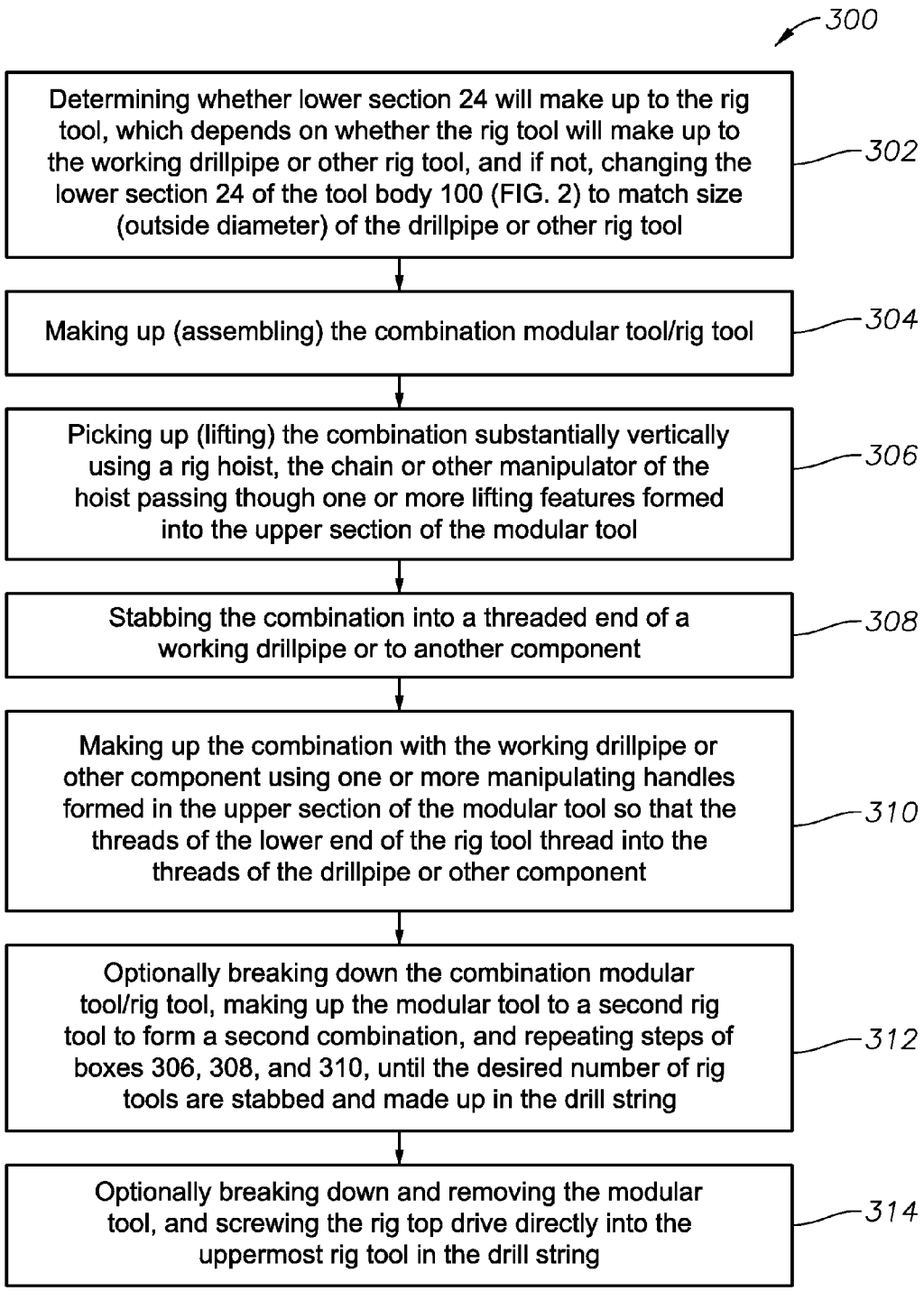
FIG. 5 is a logic diagram of a method of installing a combination modular tool/rig tool onto a working drillpipe, and optionally a second rig tool onto the first rig tool.

FIG. 5 is a logic diagram of a method embodiment 300 for easily and safely making up a rig tool with a drill string, and optionally a second rig tool to the first rig tool, and/or the rig top drive. Method embodiment 300 first comprises determining whether lower section 24 will make up to the rig tool, which depends on whether the rig tool will make up to the working drillpipe or other rig tool, and if not, changing the lower section 24 of the release tool body 100 (FIG. 2) to match size (outside diameter) of the drillpipe or other rig tool (box 302). The method further comprises making up (assembling) the combination of modular tool/rig tool, (box 304). The method further comprises picking up (lifting) the combination substantially vertically using a rig hoist, the chain or other manipulator of the hoist passing though one or more lifting features formed into the upper section of the modular tool (box 306). The method then comprises stabbing the combination into a threaded end of a working drillpipe or to another component (box 308). The method further comprises making up the combination with the working drillpipe or other component using one or more manipulating handles formed in the upper section of the modular tool so that the threads of the lower end of the rig tool thread into the threads of the drillpipe or other component, box 310. Optionally (box 312), method embodiment 300 includes breaking down the combination modular tool/rig tool, making up the modular tool to a second rig tool to form a second combination, and repeating the steps of boxes 306, 308, and 310, until the desired number of rig tools are stabbed and made up in the drill string, and optionally (box 314) breaking down and removing the modular tool, and screwing the rig top drive directly into the uppermost rig tool in the drill string.

The critical steps are lifting the combination of modular tool/rig tool to a position over the working drillpipe threaded end using the one or more formed lifting features 32 on the modular tool, the lifting feature positioned such that when the modular tool body and rig tool attached thereto are lifted by a manipulator, they are easily moved over, aligned with, and connected with the working drillpipe while minimizing possibility of the manipulator cables, chains, or straps slipping off. This lifting feature, in conjunction with formed handles 56, 58, also helps with the step of threading the combination onto the working drillpipe or other rig tool.

An important feature of the apparatus and methods disclosed herein is the modularity, that is, the lower and upper sections 22, 24 of the modular tool body may quickly and easily be disassembled, and the same upper section 22 joined and used with another lower section 24 of same or different outside diameter, for example if the lower section is cracked or otherwise becomes unusable, or if there is a need to change to a different size drillpipe. In certain embodiments, the method comprises determining whether lower section 24 will make up to the drillpipe or other rig tool, which depends on whether the rig tool will make up to the working drillpipe, and if not, changing the lower section 24 of the modular tool body to match size (outside diameter) of another rig tool.

Figure 6:
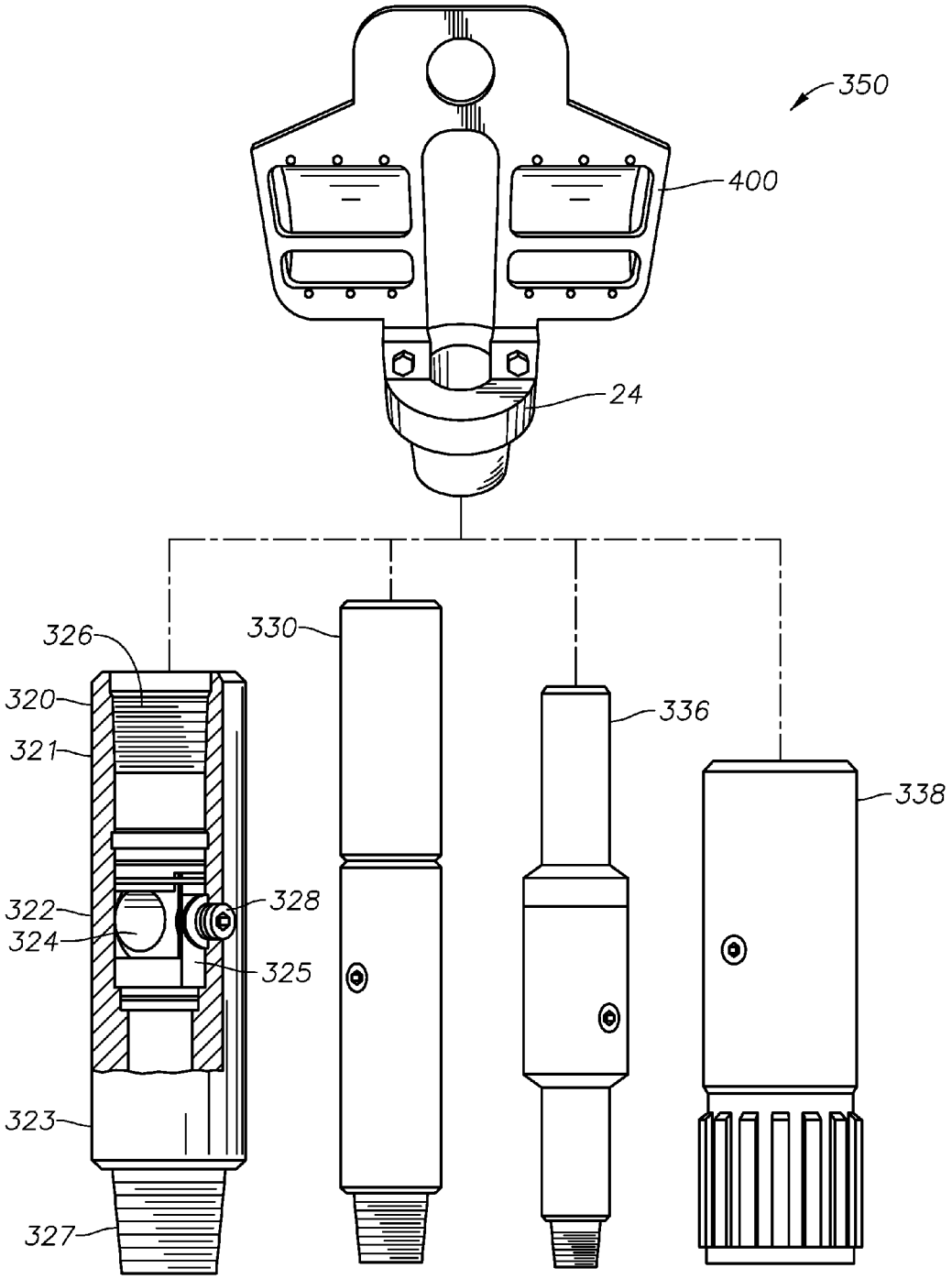
FIGS. 6 and 7 are schematic perspective views of another modular tool embodiment in accordance with the present disclosure, and side elevation views (partially in cross-section) of kelly valves that may be picked up and stabbed using the modular tools of this disclosure.
Figure 7:
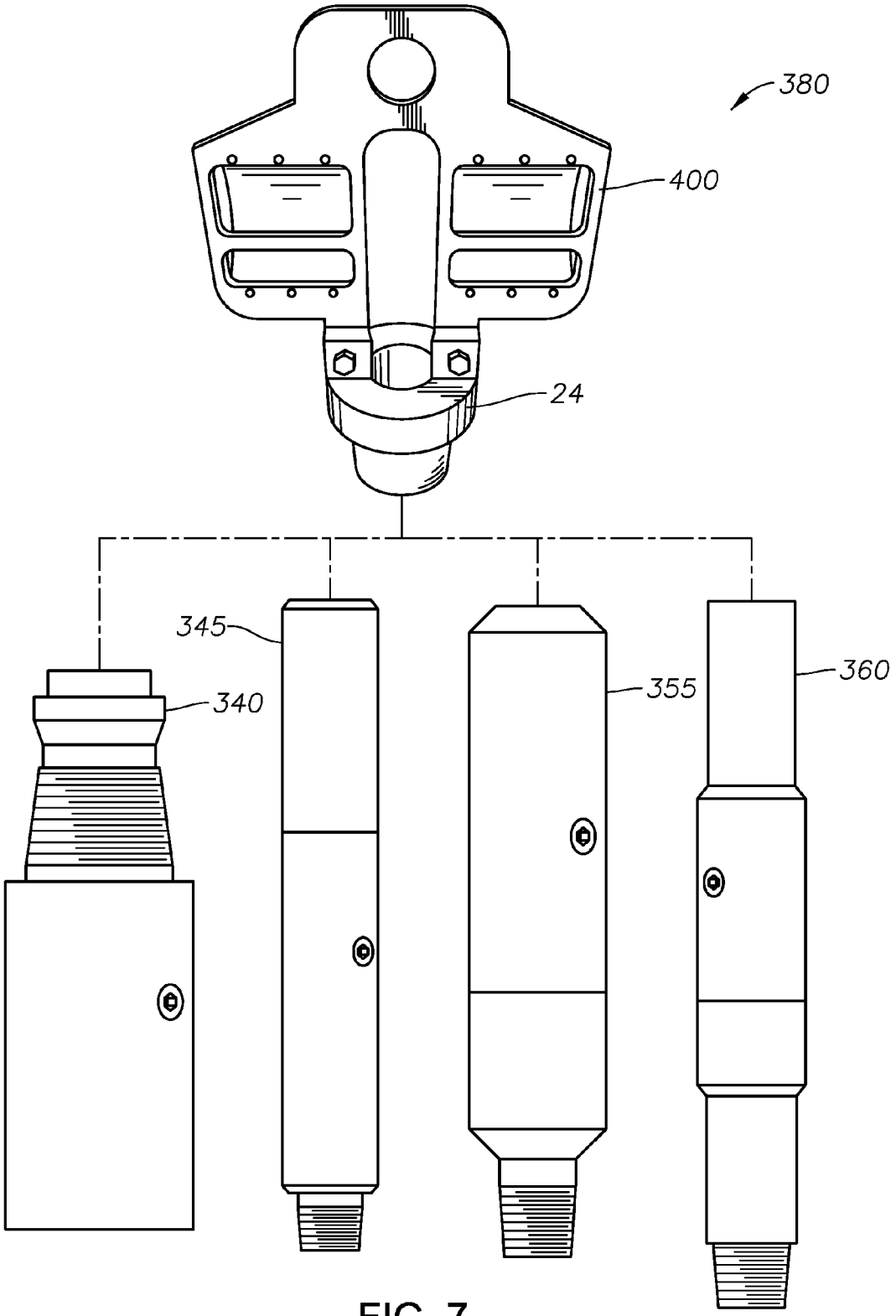

FIGS. 6 and 7 are schematic perspective views of another modular tool embodiment in accordance with the present disclosure, and side elevation views (partially in cross-section) of valves that may be picked up and stabbed using the modular tools of this disclosure. Embodiment 350 illustrated schematically in FIG. 6 actually is four embodiments of combinations of the modular tool formed by upper section 400 and lower section 24 combined with four different ball valves useful as kelly valves, safety valves, or top drive valves. For example, the kelly valve illustrated schematically at 320 is the kelly valve known under the trade designation ONE-PIECE CANISTER GUARD™ kelly valve; the kelly valve illustrated schematically at 330 is the kelly valve known under the trade designation TWO-PIECE CANISTER GUARD™ kelly valve; the safety valve illustrated schematically at 336 is the safety valve known under the trade designation TWO-PIECE CANISTER GUARD™ safety valve; and the valve illustrated schematically at 338 is the top drive valve known under the trade designation TOP DRIVE CANISTER GUARD™ valve, all available from M & M International, Broussard, La., USA. The construction and operation of these valves is well known and forms no part of the present disclosure except when combined with and used in conjunction with a modular tool of the present disclosure. Because the internals of each ball valve in FIGS. 6 and 7 are very similar, internals for only one ball valve, 320 in FIG. 6, are detailed here in partial cross-section. Ball valve 320 includes an upper section 321, a middle section 322, and a lower section 323, the middle section 322 including the actual ball 324 in a ball holder or ball cage 325, as is known. Internal threads 326 on upper section 321 are illustrated schematically, while pin end threads are illustrated schematically at 327. The "nut" or socket item 328 in middle section 322 is where a hand or machine crank is attached to open or close the ball valve.

Embodiment 380 illustrated schematically in FIG. 7 actually is four embodiments of combinations of the modular tool formed by upper section 400 and lower section 24 combined with four different ball valves useful as kelly valves, safety valves, or top drive valves. For example, the top drive valve illustrated schematically at 340 is the top drive valve known under the trade designation TOP DRIVE BOTTOM LOAD™ SYSTEM, and the safety and kelly valve illustrated schematically at 345 is an old standard construction safety and kelly valve, both available from M & M International, Broussard, La., USA. The ball valve illustrated schematically at 355 in FIG. 7 is a schematic illustration of an API Class I ball type kelly valve, while the ball valve illustrated schematically at 360 in FIG. 7 is a schematic illustration of an API Class II ball type kelly valve, both available from TIW Corporation, Houston, Tex., USA. The construction and operation of these valves is well known and forms no part of the present disclosure except when combined with and used in conjunction with a modular tool of the present disclosure.

Figure 8:
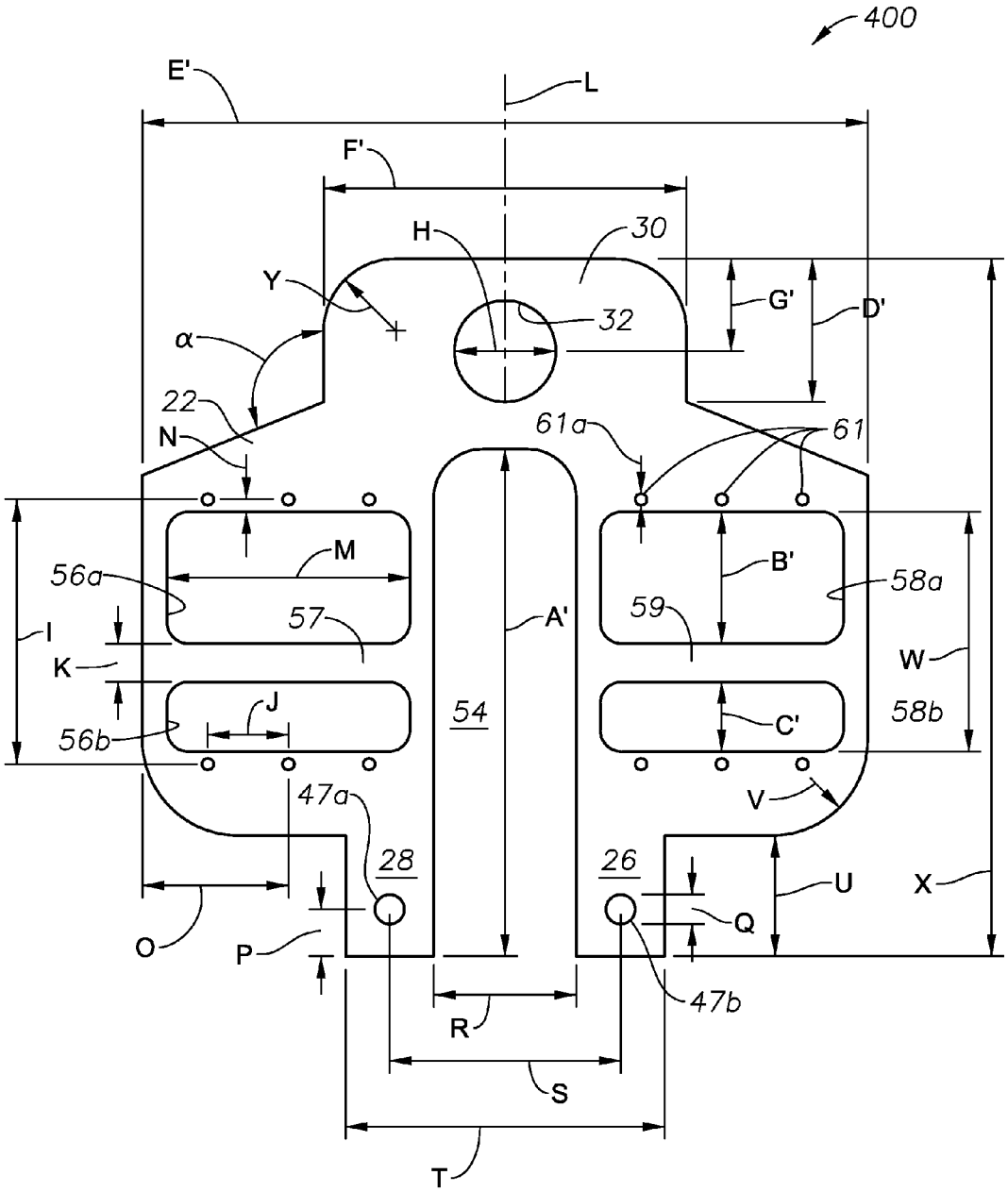
FIG. 8 is a side elevation view of another embodiment of the disclosure.
Figure 9:
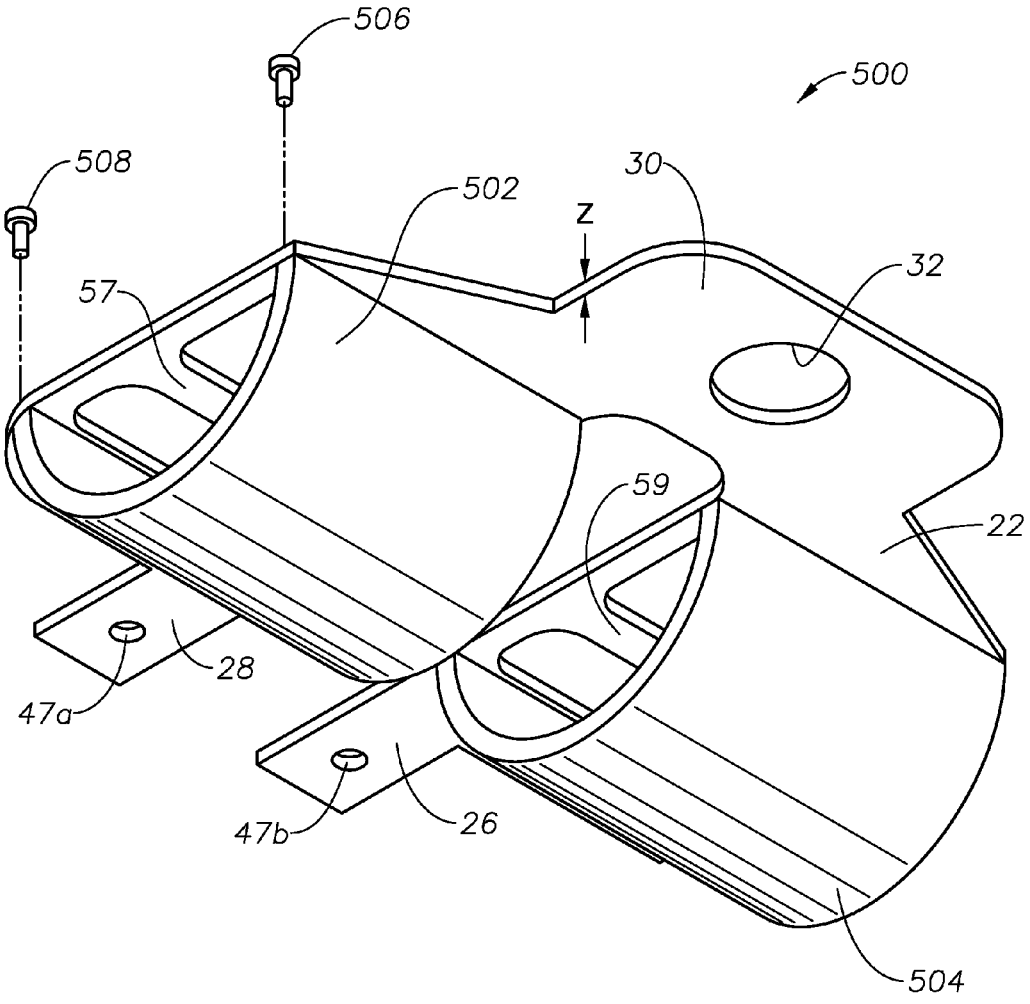
FIG. 9 is a perspective view and FIG. 10 is a side elevation view of another embodiment of the disclosure.

FIG. 8 illustrates schematically another embodiment 400 of upper section 22 of one embodiment of modular tools of the present disclosure, illustrating formed slots 56*a*, 56*b*, 58*a*, and 58*b*, defining generally horizontal hand holds 57, 59. Also provided are a series of formed through holes 61 (12 total illustrated in embodiment 400, although this number could vary up or down) allowing a pair of hand guards 502, 504 (FIGS. 9, 10) to be attached using threaded bolts 506, 508 (FIG. 9). A pair of through holes 47*a*, 47*b* are provided for attachment of embodiment 400 to lower section 24 (not illustrated in FIGS. 8-10). The proportional dimensions, lengths, angles, and radii illustrated in FIGS. 8 and 9 are typical and not meant to be limiting in any way. Length dimensions to be noted are designated by the following designations: A', B', C', D', E', F', G', H, I, J, K, M, N, O, P, Q, R, S, T, U, V, W, X, Y, and Z, where Z is the thickness of the entire embodiment 400, which is preferably 0.5 inch, but could be thicker or slightly thinner, depending on the strength requirements. Furthermore, although the preferred metal for embodiment 400 is aluminum, other metals and/or metal alloys could be used. Aluminum is preferred for its low weight, although billet aluminum will weigh more than cast aluminum. Angle "a" is noted in embodiment 400 to be 112.5 degrees, but angle $\alpha$ could vary from 90 to about 135 degrees. Furthermore, the diameter of attachment holes 61 is noted in embodiment 400 to be 0.25 inch (at 61*a*), but this dimension may vary, as may the number of such attachment holes.

Still referring to FIG. 8 and embodiment 400, the various dimensions and their ranges may be as listed in Table 1, acknowledging that dimensions outside of these ranges may be acceptable.

TABLE 1

Dimensions of Embodiment 400

| Dimension | Embodiment 400 (inch) | Preferred Range (inch) |
|---|---|---|
| A' | 10.551 | 5-25 |
| B' | 2.724 | 1-10 |
| C' | 1.500 | 0.5-5 |
| D' | 3.000 | 1-10 |
| E' | 15.000 | 10-30 |
| F' | 7.500 | 5-15 |
| G' | 1.899 | 1-5 |
| H | 2.100 | 1-5 |
| I | 5.500 | 2-10 |
| J | 1.685 | 1-3 |
| K | 0.776 | 0.5-2 |
| M | 5.055 | 2-10 |
| N | 0.250 | 0.125-2 |
| O | 3.028 | 1-5 |
| P | 1.000 | 0.25-3 |
| Q | 0.625 | 0.25-3 |
| R | 2.89 | 1-5 |
| S | 4.716 | 2-10 |
| T | 6.500 | 3-15 |
| U | 2.500 | 1-10 |
| V | 2.000 | 1-5 |
| W | 5.000 | 3-20 |
| X | 14.50 | 7-40 |
| Y | 1.500 | 0.5-5 |
| Z | 0.500 | 0.3-3 |
| 61a | 0.250 | 0.125-2 |

Figure 10:
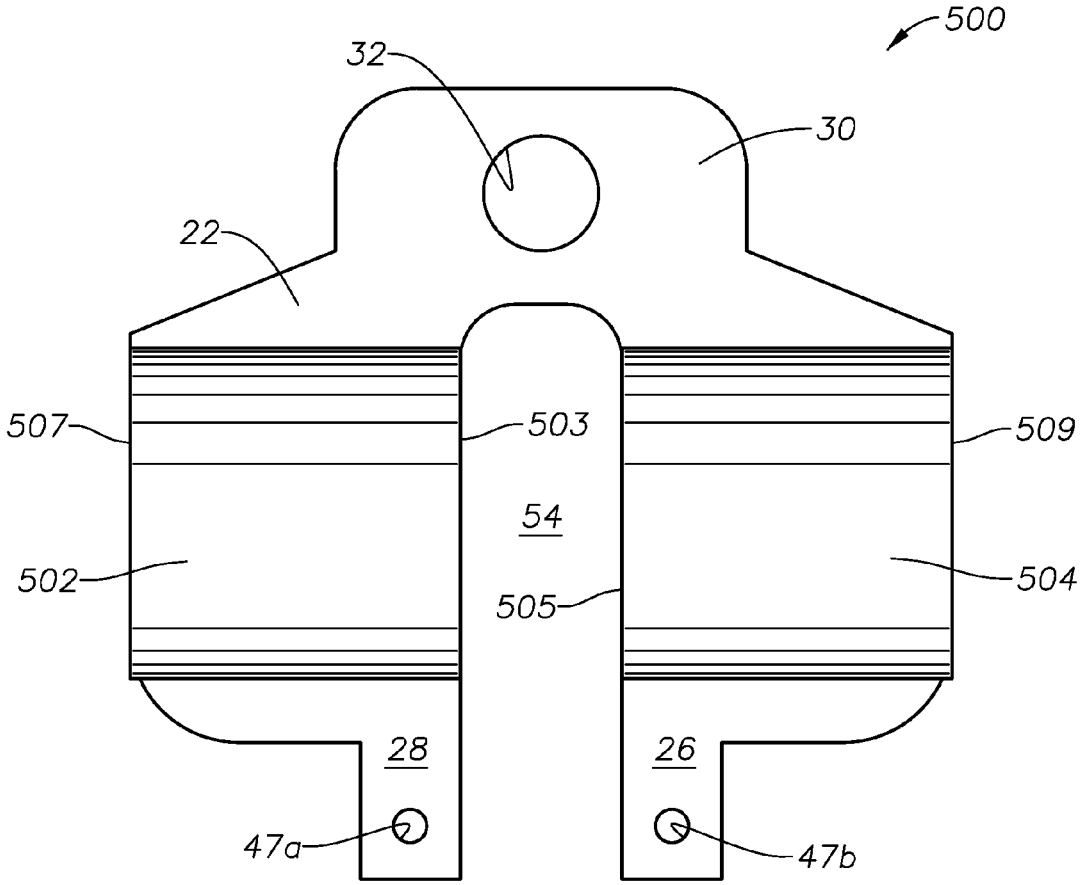

FIGS. 9 and 10 illustrate schematic perspective and side elevation views, respectively, of embodiment 500 of upper section 22 of embodiment 400 having two hand guards 502, 504 attached thereto using bolts 506, 508. In embodiment 500, there would be six bolts 506, and six bolts 508, corresponding to the twelve through holes 61 illustrated in FIG. 8. It will be understood that a similar arrangement would be provided for attaching hand guard 504, the bolts not being illustrated for clarity. Hand guards 502, 504, are preferably formed from 0.5-inch aluminum pipe that is split in half and milled to provide threaded holes for receiving bolts 506, 508. Embodiment 500 and equivalents thereof provide a lightweight upper section 22, while providing added protection to workers' hands. In other embodiments, one hand guard, say 502 for example, may be attached to the opposite side of upper section 22, so that one hand guard is on each side of upper section 22. In yet other embodiments, hand guards 502, 504 need not be round or cylindrical in shape, but could for example be box-shaped, elliptical, triangular, pyramidal (for example, three or four sided), prism-shaped, hemispherical or semi-hemispherical-shaped (dome-shaped), or combination thereof and the like. The side elevation view of FIG. 10 illustrates a preferred arrangement of hand guards 502, 504, in that their inside edges 503, 505 are substantially co-extensive with edges of central open region 54, and their outer edges 507, 509 are substantially co-extensive with respective outer edges of the upper section 22, but this arrangement is not strictly necessary in all embodiments. For example, one or more edges 503, 505, 507, 509 could be rounded inward to allow easier access to hand holds 57, 59 (FIG. 9), or rounded outward to provide even more hand protection. It will be understood that embodiments with only one hand hold 57 or 59, and one corresponding hand guard 502 or 504, are part of this disclosure and deemed with in the claims. Furthermore, the shape of and external ornamentation on upper section 22, hand holds 57, 59, and hand guards 502, 504 are arbitrary and may be modified from that illustrated. For example, hand guards 502, 504 may be ornamented with various ornamentation produced in various ways (for example stamping or engraving, or raised features such as reflectors, reflective tape, patterns of threaded round-head screws or bolts screwed into holes in hand guards 502, 504), such as oil rig designs, oil tool designs, logos, letters, words, nicknames (for example BIG JAKE, and the like). Hand holds 57, 59 may be machined or formed to have easy-to-grasp features for fingers, or may have rubber grips shaped and adorned with ornamental features, such as raised knobby gripper patterns.

The valve in an IBOP, whether a flap valve or dart valve, and in kelly valves (typically ball valves) must stay open at all times during picking up, alignment, and threading onto a working drillpipe. In typical practice, when installing an IBOP onto a working drillpipe one of the rig workers place their hand on top of the release rod 16 (FIG. 1) and press's down. This will press release rod 16 down and compress a spring under a dart holding the valve open. One of the rig workers will tighten the rod lock screw, then the valve is locked open until the rod lock screw is loosened. Once loosened, the spring under the dart will expand and slam the valve closed. The release rod 16 will not come completely out of the release tool upper section 22 unless a rig worker unscrews release tool body lower section 24 from upper sub 2 of the IBOP. The IBOP valve must be open in case of an emergency so that rig workers can pick up the complete combination IBOP and modular tool and screw the lower sub threads into the working drillpipe. In situations where a kelly valve has not already been installed, drilling fluid, drilling mud, production fluid, and perhaps hydrocarbons and solids may be blowing out while the rig workers are screwing a combination kelly valve/modular tool or a combination IBOP/modular tool into the working drillpipe. Once they have the combination in place, if the valve is a kelly valve they close the valve, and if the valve is a IBOP, they release a rod lock screw and let the valve close and stop the flow of fluid. Some or all of these features related to use with IBOPs are discussed more fully in my serial number 14464663, filed Aug. 20, 2014.

Figure 11:
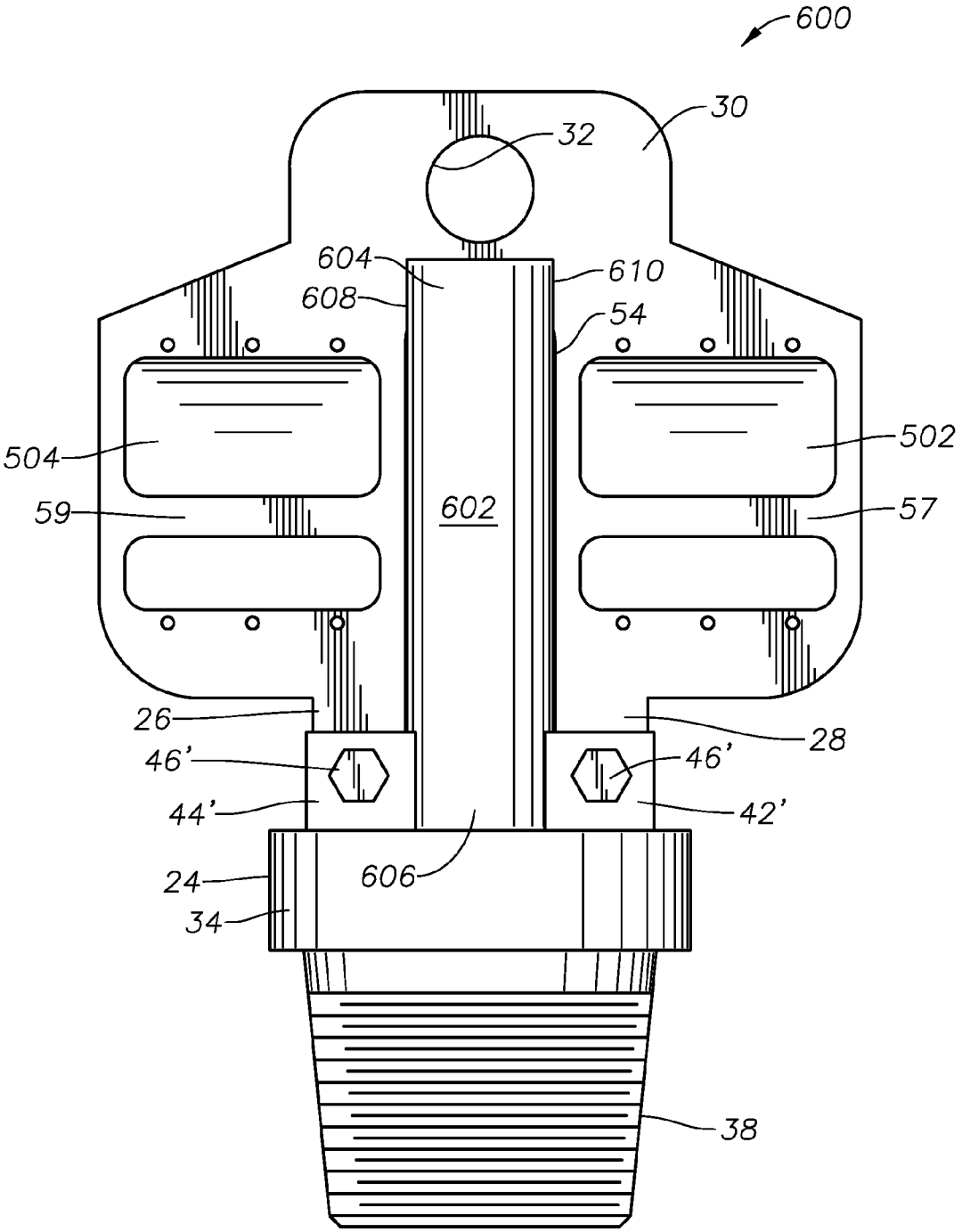
FIGS. 11 and 12 are side elevation views of opposite sides of an embodiment including a fluid diversion cap, with FIG. 13 being a close-up perspective view of this embodiment.
Figure 12:
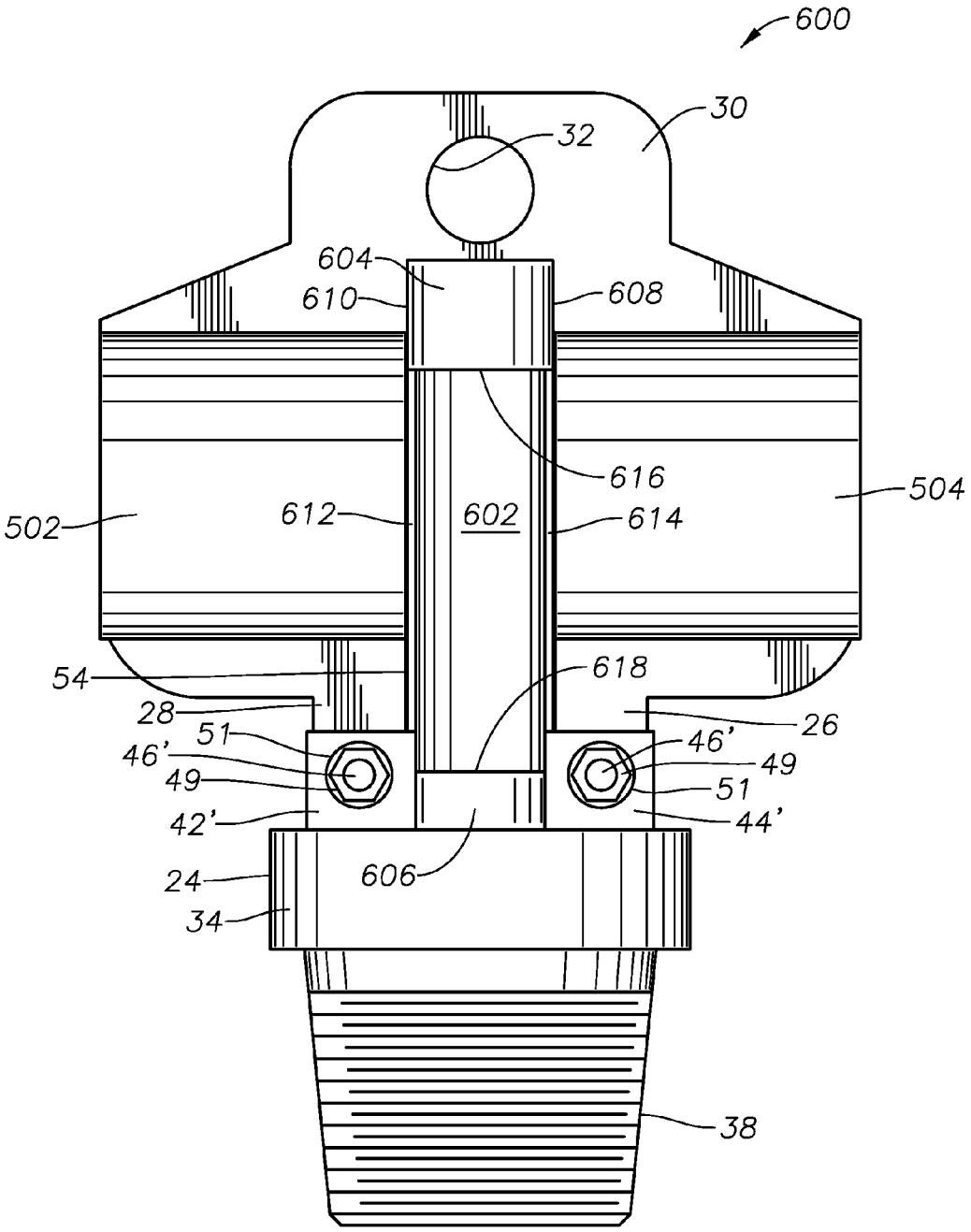
Figure 13:
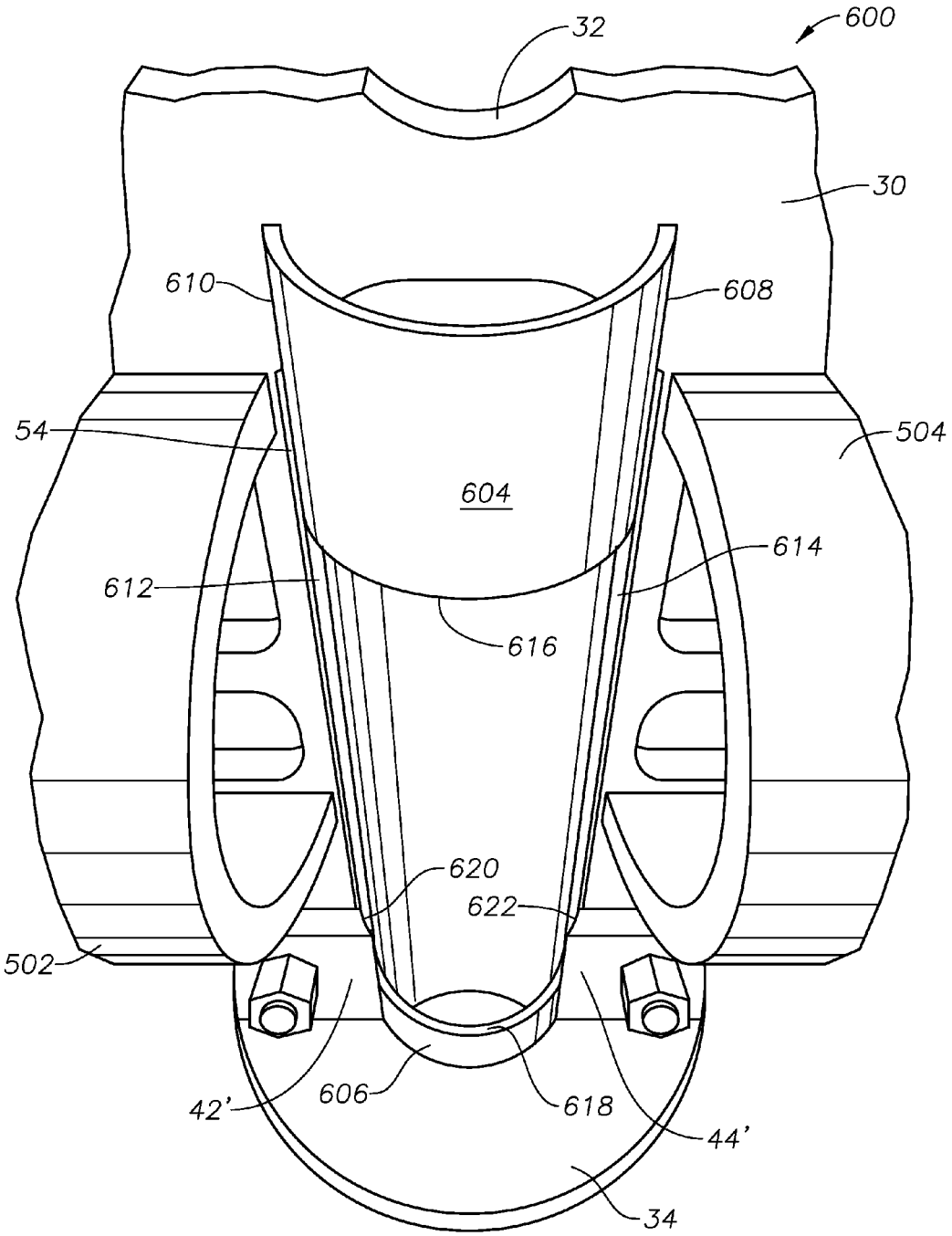

FIGS. 11 and 12 are side elevation views of opposite sides of an embodiment 600 including a fluid diversion cap 602, with FIG. 13 being a close-up perspective view of embodiment 600. As noted previously, certain embodiments may include a one-piece, formed, tubular metallic fluid diversion cap 602 removably attached to the top manipulating end 30 of the upper section 22 and having the same longitudinal axis as the upper and lower sections. Fluid diversion cap 602 may comprise an upper tubular end 604 having slots 608, 610 dimensioned to substantially mate with a lower region of top manipulating end 30 of upper section 22. Fluid diversion cap 602 may comprise a lower tubular end 606 dimensioned to substantially mate with curved inner surfaces 620, 622 of receptacles 42' and 44', and fit snugly therein when bolts 46' are secured with washers 49 and nuts 51. An opening is machined or cut into fluid diversion cap 602, the opening defined by edges 612, 614, 616, and 618 (FIGS. 12 and 13). This opening allows fluids to escape (be "diverted") in a direction away from the person making up the connection of the cap with the TIW valve or other device. Fluid diversion cap 602 fits substantially between longitudinal members 26, 28 and in central open region 54 there between. As used here when describing the fluid diversion cap, the phrase "substantially mate with" means the fitting or mating of the slots with a lower region of the top manipulating end of the upper section does not need to be a friction fit; similarly, the a lower tubular end dimensioned to substantially mate with curved inner surfaces of the upper end of the lower section need not perfectly mate, as long as the upper and lower ends 604, 606 are not able to easily be removed once bolts 46' are tight.

Thus the apparatus, combinations, and methods described herein provide a quick and safe way of quickly picking up, aligning, and attaching a rig tool to a working drillpipe or to another installed valve without extraneous mechanical frames and with significantly reduced risk of injury to rig workers.

Certain method embodiments may include using a mobile offshore drilling unit (MODU). Certain method embodiments may comprise disconnecting an umbilical or other flexible conduit using a quick disconnect (QDC) coupling configured as part of one or more subs 70. Certain subsea method embodiments may include assuring flow of fluid through one or more rig tools using external wet insulation on at least a portion of the outer valve for flow assurance. Certain subsea method embodiments may include assuring flow of fluid through a rig tool using a flow assurance fluid, for example a gas atmosphere in the annulus between the inner and outer body of an insulated IBOP, or hot seawater or other water pumped into an IBOP, or methanol. Certain subsea method embodiments may comprise fluidly connecting a source of hydrate inhibition fluid to the IBOP via one or more subs 70.

Over the past several years, the suitability of using high strength steel materials and specially designed thread and coupled (T&C) connections that are machined directly on the joints at the mill has been investigated. See Shilling et al., "Development of Fatigue Resistant Heavy Wall Riser Connectors For Deepwater HPHT Dry Tree Risers", OMAE2009-79518. These connections eliminate the need for welding and facilitate the use of materials like C-110 and C-125 metallurgies that are NACE qualified. The high strength may significantly reduce the wall thickness required, enabling rig tools to be designed to withstand pressures much greater than can be handled by X-80 materials and installed in much greater water depths due to the reduced weight and hence tension requirements. The T&C connections eliminate the need for 3$^{rd}$ party forgings and expensive welding processes—considerably improving apparatus delivery time and overall cost. For onshore use, the modular tool and rig tool structural components may be made of 4140HT steel, aluminum (preferably billet) or equivalent material.

From the foregoing detailed description of specific embodiments, it should be apparent that patentable apparatus, combinations, and methods have been described. Although specific embodiments of the disclosure have been described herein in some detail, this has been done solely for the purposes of describing various features and aspects of the apparatus, combinations, and methods, and is not intended to be limiting with respect to their scope. It is contemplated that various substitutions, alterations, and/or modifications, including but not limited to those implementation variations which may have been suggested herein, may be made to the described embodiments without departing from the scope of the appended claims. For example, one modification would be to take the lower section of the structure and modify it to include internal threading on the top extension and fit a bleeder valve thereon. Such embodiments may be useful with casing. Furthermore, the formed slots 56*a*, 56*b*, 58*a*, and 58*b*, and hand holds 57, 59 defined thereby, need not be horizontal, but may be vertical or angled between horizontal and vertical.

What is claimed is:

1. A modular tool body comprising:

a one-piece, formed, planar metallic upper section having a longitudinal axis, the upper section comprising a pair of longitudinal members defining a central open region, each longitudinal member having a lower end, the longitudinal members joined by a top manipulating end having one or more lifting features formed therein configured to accept one or more manipulators, the one or more formed lifting features positioned such that when the modular tool body and a valve connected thereto are lifted by the one or more manipulators, they are configured to allow the modular tool body and valve to be moved over, aligned with, and connected with a working drillpipe or other valve, and configured to prevent the one or more manipulators slipping off;

a one-piece, formed, tubular metallic fluid diversion cap removably attached to the upper section and having the same longitudinal axis as the upper and lower sections, the fluid diversion cap comprising an upper tubular end having slots dimensioned to substantially mate with a lower region of the top manipulating end of the upper section, a lower tubular end dimensioned to substantially mate with curved inner surfaces of the upper end of the lower section, and a fluid diversion opening; and a one-piece, formed, tubular metallic lower section removably attached to the upper section having the same longitudinal axis as the upper section, the lower section comprising:

a threaded pin end configured to threadedly mate with a threaded box end of the valve;

a central longitudinal bore; and an upper end formed to accept the lower ends of the longitudinal members of the upper section and retaining members therefore.

2. The modular tool body of claim 1 wherein the one or more lifting features is a single centered lifting eye formed through the top manipulating end of the upper section.

3. The modular tool body of claim 1 further comprising one or more formed, elongate slots in each longitudinal member configured to define one or more manipulating handles for a rig worker or mechanical manipulator to grasp the upper section and rotate the modular tool and thread the threaded pin end of the lower section into section into the threaded box end of the drillpipe or other valve.

4. The modular tool body of claim 1 wherein the upper end of the lower section is formed to include a pair of vertical receptacles for the lower ends of the upper section, and wherein the retaining members comprise one or more screws threaded through corresponding threaded bores through the receptacles and lower ends.

5. The modular tool body of claim 1 wherein the formed upper and lower sections are each formed from molded, cast or billet metal that is subsequently milled or machined to form the upper and lower sections.

6. A modular tool comprising:

a one-piece, formed, planar metallic upper section having a longitudinal axis, the upper section comprising a pair of longitudinal members defining a central open region, each longitudinal member having a lower end, the longitudinal members joined by a top manipulating end having one or more lifting features formed therein configured to accept one or more manipulators, the one or more formed lifting features positioned such that when the modular tool body and a rig tool connected thereto are lifted by the one or more manipulators, they are configured to allow the modular tool body and rig tool to be moved over, aligned with, and connected with a working drillpipe or other, and configured to prevent the one or more manipulators slipping off;

a one-piece, formed, tubular metallic fluid diversion cap removably attached to the upper section and having the same longitudinal axis as the upper and lower sections, the fluid diversion cap comprising an upper tubular end having slots dimensioned to substantially mate with a lower region of the top manipulating end of the upper section, a lower tubular end dimensioned to substantially mate with curved inner surfaces of the upper end of the lower section, and a fluid diversion opening; and a one-piece, formed, tubular metallic lower section removably attached to the upper section having the same longitudinal axis as the upper section, the lower section comprising:

a threaded pin end configured to threadedly mate with a threaded box end of the rig tool;

a central longitudinal bore; and an upper end formed to accept the lower ends of the longitudinal members of the upper section and retaining members therefore; and one or more formed, elongate slots in each longitudinal member configured of size sufficient to define one or more manipulating handles for a rig worker or mechanical manipulator to grasp the upper section and rotate the modular tool and thread the threaded pin end of the lower section into the threaded box end of the drillpipe or other rig tool.

7. The modular tool of claim 6 wherein the one or more lifting features is a single centered lifting eye milled through the top manipulating end of the upper section.

8. The modular tool of claim 6 wherein the upper end of the lower section is milled to include a pair of vertical receptacles for the lower ends of the upper section, and wherein the retaining members comprise one or more screws threaded through corresponding threaded bores through the receptacles and lower ends.

9. The modular tool of claim 6 wherein the formed upper and lower sections are each formed from molded, cast or billet metal that is subsequently milled or machined to form the upper and lower sections.

10. The modular tool of claim 6, further comprising a combination of metallurgy and structural reinforcement such as to prevent failure of the modular tool upon exposure to inner pressure up to 10,000 psia.

11. A combination modular tool and rig tool for threadedly attaching to a drillpipe or to a second rig tool, the drillpipe or second rig tool having a threaded end for engaging the rig tool, the combination comprising a rig tool having a lower end threadedly engageable with the drillpipe threaded end and an upper box end threadedly engaged with the modular tool of claim 6.

12. The combination of claim 11 wherein the one or more lifting features is a single centered lifting eye formed through the top manipulating end of the upper section.

13. The combination of claim 11 wherein the upper end of the lower section is formed to include a pair of vertical receptacles for the lower ends of the upper section, and wherein the retaining members comprise one or more screws threaded through corresponding threaded bores through the receptacles and lower ends.

14. The combination of claim 11 further comprising one or more subsea hot stab ports for subsea ROV intervention and/or maintenance of the rig tool.

15. The combination of claim 11 comprising one or more ports allowing pressure and/or temperature monitoring inside the rig tool.

16. The combination of claim 11 further comprising a combination of metallurgy and structural reinforcement such as to prevent failure of the rig tool upon exposure to inner pressure up to 10,000 psia.

17. The combination of claim 11 further comprising one or more subsea umbilicals fluidly connected to locations on the rig tool selected from the group consisting of a kill line, a choke line, and both kill and choke lines.

18. The combination of claim 17 wherein one of the umbilicals is fluidly connected to a subsea manifold.

19. A modular tool body for use with rig tools comprising:

a one-piece, formed, planar metallic upper section having a longitudinal axis, the upper section comprising a pair of longitudinal members defining a central open region, each longitudinal member having a lower end, the longitudinal members joined by a top manipulating end having one or more lifting features formed therein configured to accept one or more manipulators, the one or more formed lifting features positioned such that when the modular tool body and a rig tool connected thereto are lifted by the cables or chains, they are configured to allow the modular tool body and rig tool to be easily moved over, aligned with, and connected with a working drillpipe or other rig tool, and configured to prevent the one or more manipulators slipping off;

a one-piece, formed, tubular metallic fluid diversion cap removably attached to the upper section and having the same longitudinal axis as the upper and lower sections, the fluid diversion cap comprising an upper tubular end having slots dimensioned to substantially mate with a lower region of the top manipulating end of the upper section, a lower tubular end dimensioned to substantially mate with curved inner surfaces of the upper end of the lower section, and a fluid diversion opening; and a one-piece, formed, tubular metallic lower section removably attached to the upper section having the same longitudinal axis as the upper section, the lower section comprising:

a threaded end configured to threadedly mate with an end of the rig tool;

a central longitudinal bore; and an upper end formed to accept the lower ends of the longitudinal members of the upper section and retaining members therefore; and two or more formed slots in each longitudinal member configured of size sufficient to define one or more generally horizontal manipulating handles for a rig worker or mechanical manipulator to grasp the upper section and rotate the modular tool and thread the pin end of the lower section into the box end of the rig tool.

20. The modular tool body of claim 19 further comprising hand guards removably attached to each longitudinal member, the hand guards positioned and configured to provide protection to a worker's hands or mechanical manipulator when grasping the generally horizontal manipulating handles.

21. The modular tool body of claim 20 wherein the hand guards are half members of split aluminum pipe attached to the longitudinal members using bolts.

* * * * *